United States Patent [19]

Berggren

[11] 4,301,846

[45] Nov. 24, 1981

[54] MACHINE FOR PRODUCING WOOD SHAVINGS FROM CHIPS

[76] Inventor: Torsten L. Berggren, Rosenlidsgatan 13, S-571 00 Nässjö, Sweden

[21] Appl. No.: 131,102

[22] Filed: Mar. 18, 1980

[30] Foreign Application Priority Data

Mar. 27, 1979 [SE] Sweden ..... 7902738

[51] Int. Cl.[3] ..... B27C 1/00

[52] U.S. Cl. ..... 144/162 R; 241/93

[58] Field of Search ..... 241/91, 92, 93, 280, 241/281; 144/162 R, 174, 176, 323

[56] References Cited

U.S. PATENT DOCUMENTS 3,759,304 9/1973 Lundmark et al. ..... 144/176
3,913,643 10/1975 Lambert ..... 144/162 R
3,991,946 11/1976 Berggren ..... 241/93

FOREIGN PATENT DOCUMENTS 2148336 4/1973 Fed. Rep. of Germany ... 144/162 R
2410176 9/1975 Fed. Rep. of Germany ... 144/162 R

*Primary Examiner*—W. D. Bray
*Attorney, Agent, or Firm*—Frishauf, Holtz, Goodman and Woodward

[57] ABSTRACT

A machine for producing thin shavings from chopped cellulose chips, in which the shavings are cut substantially in the fiber direction and have a large surface area relative to their thickness. The machine comprises a first part provided with at least one knife means and a second part provided with at least one anvil surface for the chips, the first and second parts being arranged for rotation relative to one another. The second part provided with the anvil surface comprises a center member having open, helical conveying channels for conveying the chips axially, while the first part provided with the knife means is in the form of a cylindrical ring which surrounds the center member and which closes said channels over at least a part of their axial length. The depth of the channels varies in the peripheral direction of the member, said channels being deeper at the leading edge thereof than at their trailing edge, as seen in the relative rotational direction of the member relative to the surrounding ring. The depth of the channels also suitably varies in the axial direction, said channels being deeper adjacent the inlet edge of the surrounding ring with respect to the chip flow than at the opposite edge of said ring.

10 Claims, 5 Drawing Figures

MACHINE FOR PRODUCING WOOD SHAVINGS FROM CHIPS

BACKGROUND OF THE INVENTION

The present invention relates to a machine for manufacturing from chopped cellulose chips thin shavings or flakes which are cut substantially in the direction of the fibres and which have a relatively large surface in relation to thickness.

Shavings of the aforementioned kind can be used for the manufacture of particle board and as raw-material in different pulping processes, including chemical, mechanical and thermal processes, and combinations thereof.

The conventional method of producing pulp directly from chips is encumbered with a number of serious disadvantages. These disadvantages are particularly manifest when using wood originating from sub-tropical and tropical climates, since such raw-material often comprises wood of different hardness. Because of the varying hardness of such wood, digestion and impregnation of the wood in pulping processes is uneven, which results in an uneven and varying yield. Because of the relatively large thickness of the chips, normally from 3–6 mm, the time for the impregnating liquid to penetrate the chips and to diffuse therethrough varies greatly with both chip thickness and chip density.

For the purpose of eliminating these disadvantages, it has been proposed to use shavings or flakes, which are thinner and of more uniform thickness than conventional chips. It has been discovered that thin and uniform shavings drastically shorten both impregnating times and digestion times, beside reducing the chemical consumption and heat requirement during a pulping process.

These results are very favorable, since they save energy, reduce investment costs for new pulping plants, and reduce the emission of deleterious substances to the environment. At present, technologies for the manufacture of pulp by using shavings and steam-phase digestion techniques in extremely high wood/liquid ratios are being developed in many places. By using these methods, investment costs can be reduced to as low as about 25% of those costs incurred when using present day technology in comparable plants.

The desired reduction in the thickness of chips for creating advantageous process conditions requires, however, the chips to be sliced in the plane of the fibres, suitably in the longitudinal direction, so that the average fibre length is not shortened to any appreciable extent. This requires the chips to be oriented in a specific direction prior to being cut.

Present day machines for slicing chips into thin shavings do not operate satisfactorily, however, and hence cannot be used on an industrial scale. In certain kinds of such machines the cutting pressure exerted on the chips against the knive means is not sufficiently great, thereby lowering the capacity of said machines to an unsatisfactory level. In other machines of the said kind, the means for feeding the chips and shavings, respectively, are inefficient, resulting in blockages.

Other methods of producing high-quality shavings are known, in which the shavings are cut directly from logs or blocks, thereby avoiding the intermediate chip-producing stage. These methods, however, are encumbered with a number of serious disadvantages, since they require a high-quality rawmaterial. Further, the knife means rapidly become blunt when cutting thin shavings directly from logs or blocks of hardwood. On the other hand when producing shavings or flakes from wood-chips, the chips can readily be softened with steam prior to being cut. This procedure, however, is practically impossible when the raw-material comprises large logs or blocks.

The main object of the present invention is to provide a machine in which the aforementioned disadvantages are eliminated and which enables cellulose chips to be reduced to the form of thin shavings or flakes in a simple and effective manner.

SUMMARY OF THE INVENTION

To this end, a machine of the present invention comprises first and second parts, the second part provided with an anvil surface and comprising a center part having open, helical conveying channels for feeding the chips in an axial direction; and the first part being provided with a knife means which has the form of a ring encircling the center part, the ring enclosing the channels over at least a part of their axial length. The depth of the channels varies in the peripheral direction of the center part, the channels being deeper at their leading edge than at their trailing edge as seen in the relative rotational direction of the center part in relation to the surrounding ring.

Preferably, the depth of the channels also varies axially, the channels being deeper adjacent the inlet edge of the surrounding ring with respect to the flow of chips, than at the opposite edge of the ring. The largest depth of the channels should preferably be less than the normal length of the chips, in order to obtain correct orientation of the chips. The decrease in depth of the channels, both in the peripheral direction and in the axial direction, should preferably be substantially progressive and continuous.

In a preferred embodiment, the center part has a portion which tapers to form a top and which protrudes through the surrounding ring, said tapering portion extending into a chip infeed container. Preferably, both the center part and the surrounding ring are rotatable, preferably in mutually opposite directions.

DETAILED DESCRIPTION

Figure 1:
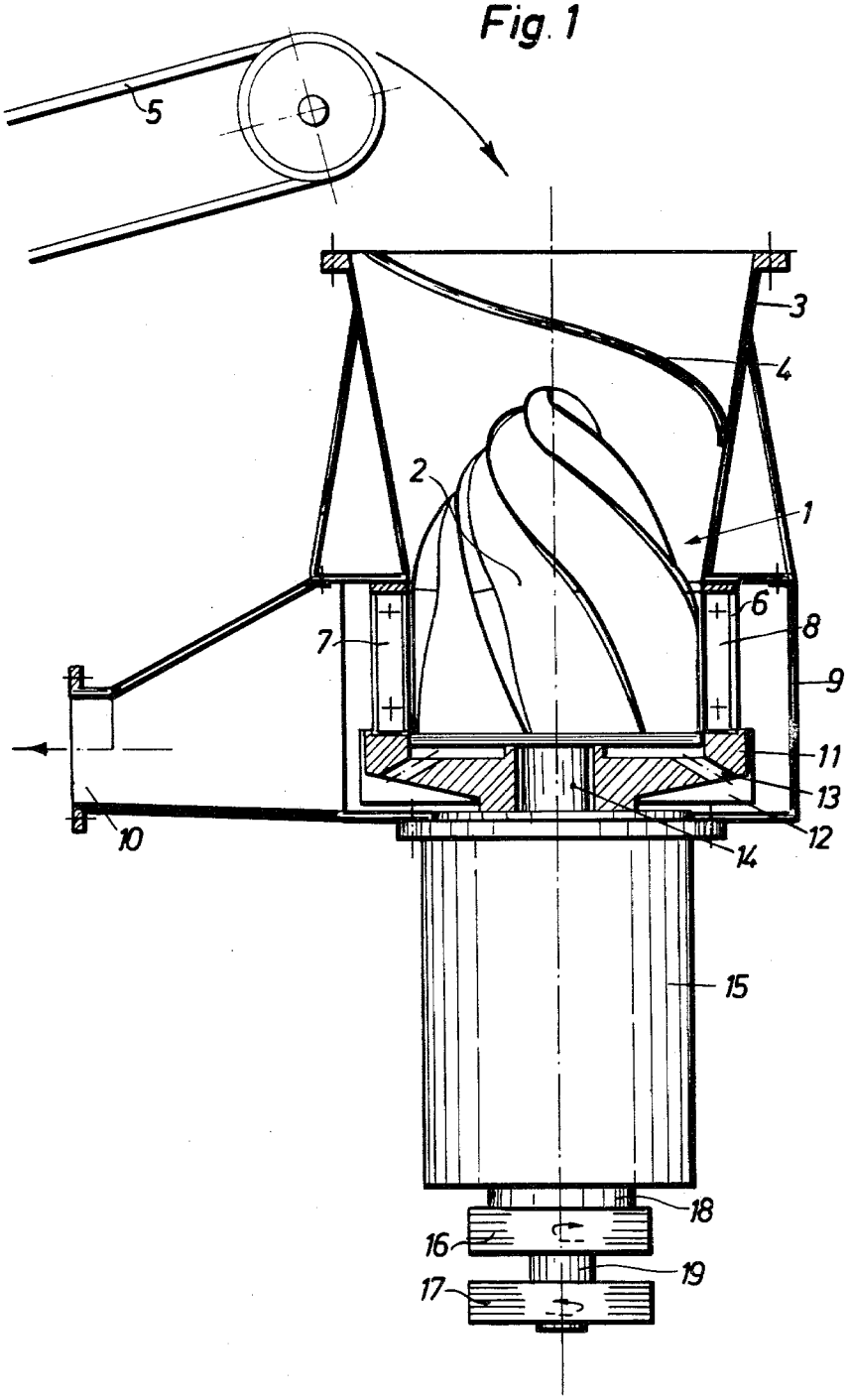
FIG. 1 is a side view of an embodiment of a the machine according to the invention, shown partly in section.

The machine illustrated in FIG. 1 comprises a rotatable center part 1 having helical conveying channels 2. The center part 1 has a portion which tapers to form a top and which projects into a chip-container 3 provided with internal guide blades 4. In the illustrated embodiment, chips are fed to the container 3 via a conveyor belt 5. The container is suitably provided with level sensing means (not shown). The lower portion of the center part 1 is surrounded by a rotatable, ring-shaped knife holder 6 provided with a plurality of knives 7 and counter knives 8, as will better be seen from FIG. 2. The ring-shaped knife holder is surrounded by a casing 9 having an outlet 10 for cut shavings.

The ring-shaped knife holder 6 is mounted on a rotary plate 11 provided with radially arranged fan and ejector wings 12 for transporting the fine material passing downwardly between the bottom flange of the center part 1 and the knifeholder 6 through openings 13. The center part 1 is mounted on a shaft 14. Both the shaft 14 and the shaft 18 of the rotor plate 11 are journalled in a housing 15. Each of the shafts 18 and 14 is driven by a V-belt pully 16 and 17, respectively, which in the illustrated embodiment are driven in opposite directions. The peripheral speed of the center part 1 is suitably from 1–5 m/second, while the knife holder 6 suitably rotates with a peripheral speed of 20–50 m/sec. The said parts may also be driven in the same direction, but at different speeds. The only essential requisite is that the relative speed obtained between the center part and the knife holder permits the chips to be cut to shavings.

The helical conveying channels 2 serve partly to feed the chips down into the cutting zones, and partly to orientate the chips, which are substantially of a parallelepipedic shape, in a manner such that the chips are cut in the plane of the fibers and preferably in the longitudinal direction thereof. The lower parts of the conveying channels 2 are outwardly restricted by the surrounding ring-shaped knifeholder 6, the depth of the channels being less than the normal length of the chips. This prevents the knives from cutting the chips transversely of the fiber direction.

Figure 2:
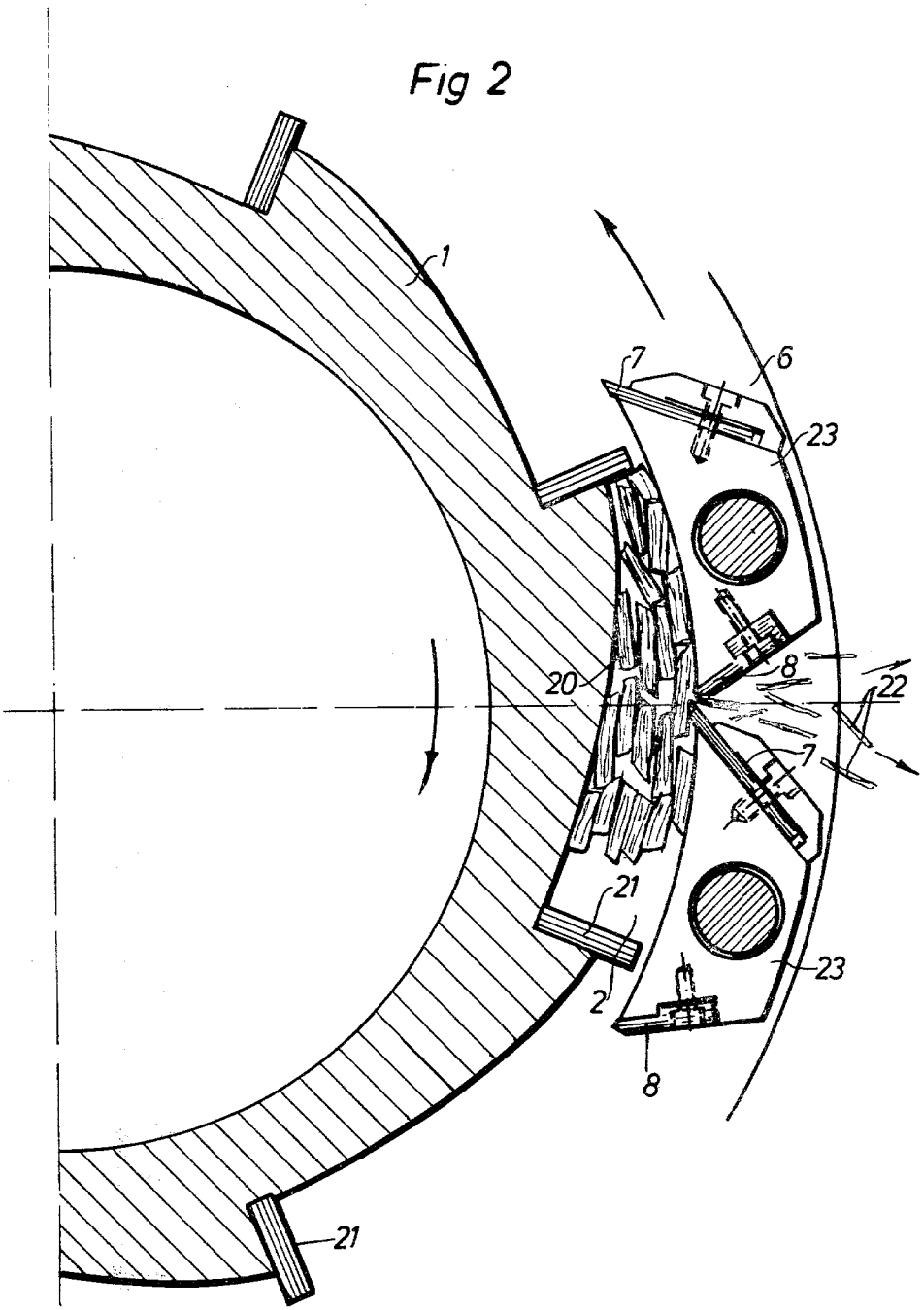
FIG. 2 is a part sectional view illustrating the attachment of the knife means to the surrounding ring and the form of the cutting zones.

FIG. 2 illustrates the manner in which the knives 7 and the counter-knives 8 are mounted on the knife holder 6 by means of separate, readily exchangable holders 23. It will also be seen from FIG. 2 that the depth of the channels 2 varies in the peripheral direction of the center part 1, the depth of the channels being greater at the leading edge of the channel than at the trailing edge thereof, as seen in the rotational direction of the center part. This provides a very favorable wedge effect, which guarantees that the chips are cut effectively and that the chips 20 are suitably oriented as a result of the forces occuring when the chips are cut, so that said chips are cut substantially in the longitudinal direction of the fibers. Those parts of the conveying channels 2 surrounded by the ring-shaped knife holder 6 are provided, as shown, with arcuate side bars 21 serving as readily exchangeable dogging or anvil elements for pushing the chips.

The depth of the conveying channels 2 also varies in the axial direction of the center part 1. Thus, the channels have their greatest depth at the upper edge of the surrounding knife holder 6, and the depth of said channels decreases progressively to reach the smallest depth at the lower edge of the knife holder. The variation in depth is progressive and continuous both in the axial direction and in the aforementioned peripheral direction, so as to ensure a continuous flow of chips.

Figure 3A:
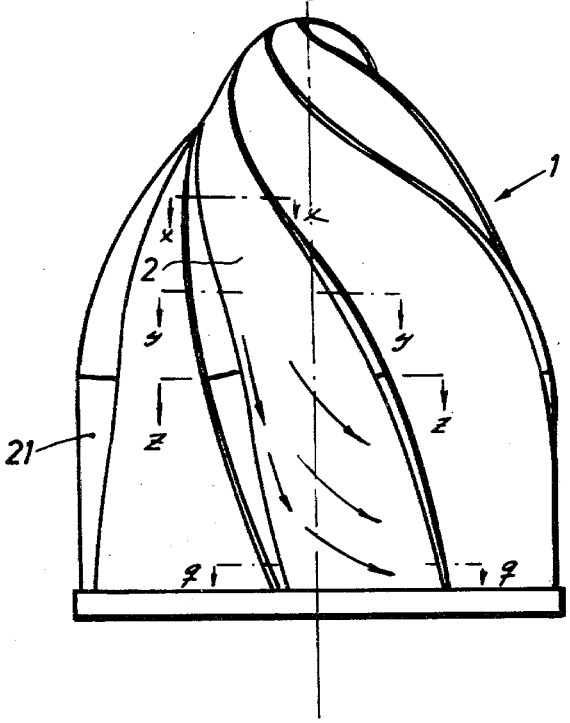
FIGS. 3A and 3B illustrate the center part in side view and plan view, respectively.
Figure 3B:
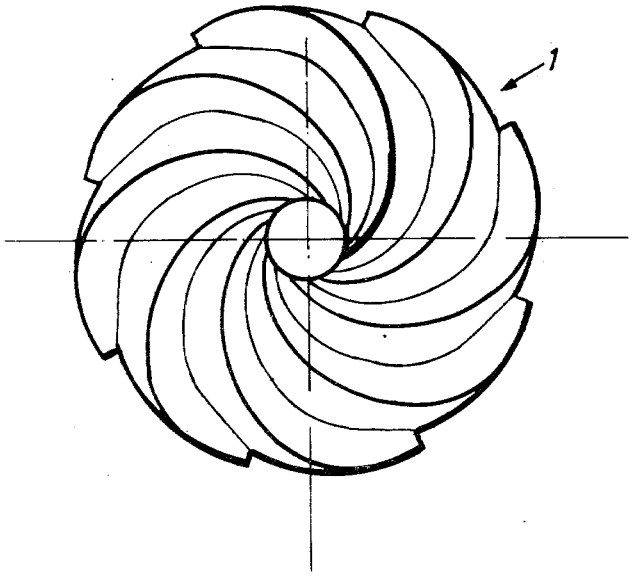
Figure 4:
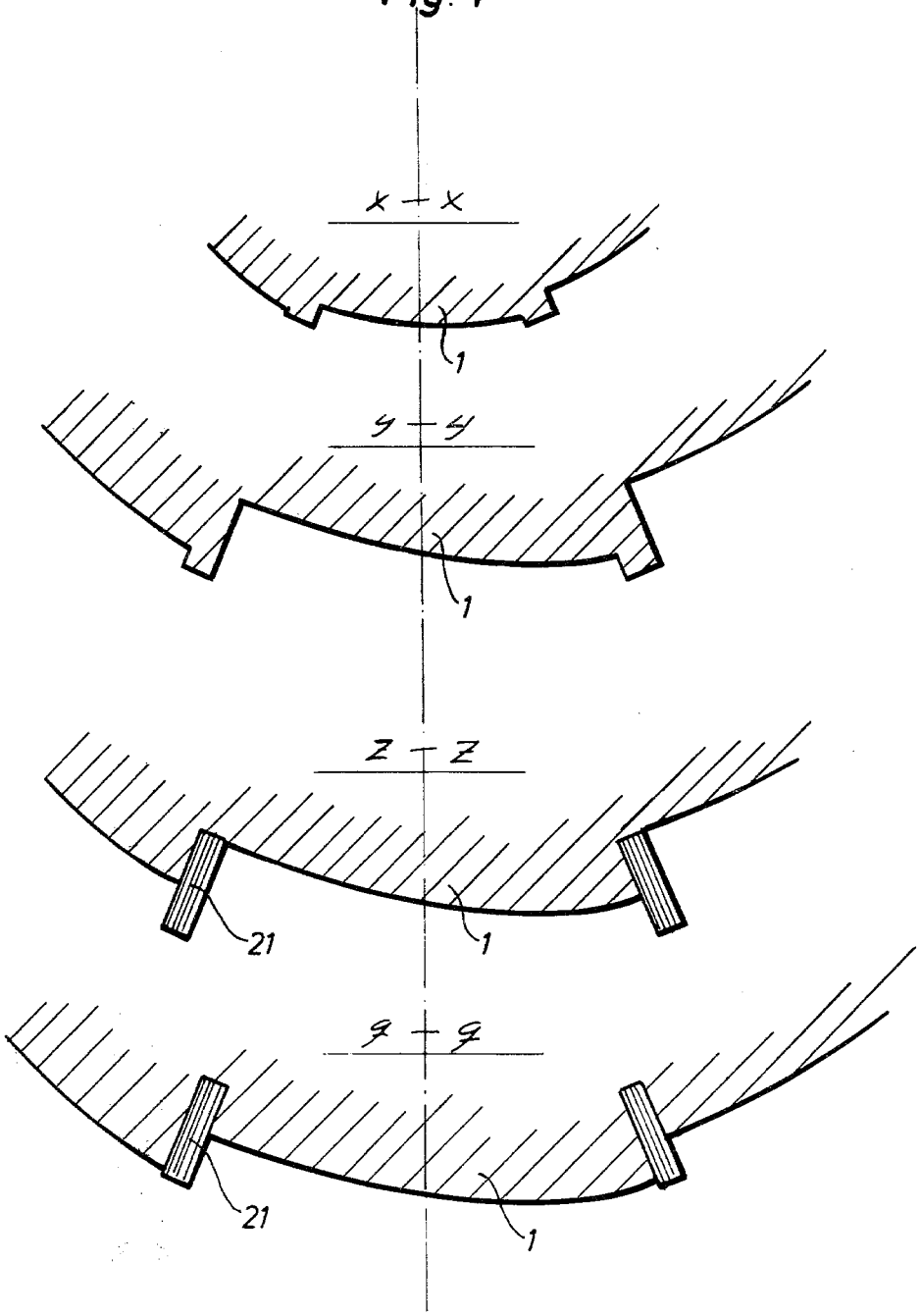
FIG. 4 is a part sectional view of the center part taken at different vertical levels.

In FIG. 3A, which is a side view of the center part illustrated in FIG. 1, section lines X—X, Y—Y, Z—Z and Q—Q have been drawn. Corresponding sectional views are illustrated in FIG. 4. These sectional views illustrate what has been mentioned in the foregoing, namely that the depth of the conveying channels 2 decreases in the peripheral direction and that said depth also varies in the axial direction, said depth being the greatest at the upper edge of the ring-like knife holder 6 (see section Z—Z). The readily exchangeable dogging bars or anvil elements 21 are illustrated in these figures.

The aforedescribed helical conveying channels 2 in the center part 1 provide an optimal combination of the following functions: (a) downfeed of the chips in the cutting zones, (b) orientation of the chips so that the chips are cut in the direction of the fibers, and (c) the chips are cut effectively and continuously.

When the illustrated apparatus is operating, the chips are conveyed mainly axially in the deepest parts of the conveying channels 2. As a result of the cutting forces, however, the chips are forced to move tangentially towards the shallower edge, said chips being forced out towards the knife holder 6 while generating an effective cutting pressure. Since the distance between the cutting means of the knife ring and the bottom of the conveying channel decreases, both upon movement of the chips from the deepest side of the conveying channels 2 to their shallower side, and upon movement axially downwardly in the channels, cutting of the chips into shavings will continue until respective chips have been totally cut into shavings or flakes. The cut shavings 22 thus obtain a peripheral speed corresponding to the speed of the knife ring 6, and are subjected to a substantial centrifugal force which assists in transporting the shavings radially out through the outlet 10. The shavings can be received on a conveying belt, or can be sucked out by means of a fan, for further transport.

Thus, the aforedescribed machine solves the problems of chip orientation prior to a cutting operation, the generation of the requisite cutting pressure, and effective discharge of the shavings. The machine has a very high cutting capacity, even with relatively limited dimensions. The means for driving both the center part and the ring-shaped knifeholder should be infinitely variable, so that the machine is able to process varying quantities of chips in an optimal manner.

The aforedescribed exemplary machine is not limiting to the invention, but can be modified in several respects. For example, when the chips are to be softened with steam prior to being cut in the machine, the chips are suitable fed to the machine by means of a screw conveyer whose surrounding casing or screw-accomodating tube is coupled to the container 3 in a sealing fashion. In this way, the steam supplied to the feed means may also contribute to transporting chips or the shavings cut therefrom through the cutting zones and out through the outlet 10. The machine need not be vertically oriented, but can be oriented in any desired manner, and may also be provided with the number of knives and conveying channels desired for each particular case.

What is claimed is:

1. A machine for producing thin shavings from chopped cellulose chips, said shavings being cut substantially in the fiber direction and having a large surface area relative to their thickness, said machine comprising:

a first part (6) having at least one knife means (7,8); and a second part (1) having at least one anvil surface (21) for pushing the chips;

said first and second parts (6,1, respectively) being arranged to rotate relative to one another about an axis;

said second part (1) including a center member (1) extending in the direction of said axis and having open, helical conveying channels (2) therein for feeding the chips in the direction of said axis, said channels (2) extending axially of said center member (1) and being helically formed thereon, said channels each communicating with at least one anvil surface (21);

said first part (6) being in the form of a cylindrical ring (6) surrounding said center member (1), said cylindrical ring (6) enclosing said channels (2) over at least a part of their axial length to define cutting zones, said channels (2) feeding said chips into said cutting zones between said center member and said cylindrical ring and into cutting engagement with said at least one knife and anvil surface; and the depth of said channels (2) varying in the peripheral direction of said center member (1) such that said channels (2) are deeper at the leading edge than at the trailing edge as seen in the relative rotational direction of said center member in relation to said cylindrical ring.

2. The machine of claim 1, wherein the depth of said channels (2) also varies in the direction of said axis, said channels being deeper adjacent the inlet edge of said cylindrical ring with respect to the chip flow than at the opposite edge of said ring.

3. The machine of claim 1 or 2, wherein said channels (2) have a greatest depth which is less than the normal length of the chips.

4. The machine of claim 2, wherein said variations in depth of said channels (2) is substantially progressive and continuous in both said peripheral direction and in said direction of said axis.

5. The machine of claim 1, wherein said center member (1) has a portion which tapers to a top, said tapering portion projecting up through said cylindrical ring (6).

6. The machine of claim 5, comprising a chip infeed container (3) extending above said cylindrical ring (6), said top of said center member (1) projecting into said chip infeed container.

7. The machine of claim 1 or 2, wherein said channels (2) have defining walls, and said at least one anvil surface (21) defines at least one defining wall of said channels (2).

8. The machine of claim 7 wherein each of said channels (2) has a defining wall which includes at least one anvil surface (21).

9. The machine of claim 1, wherein both said center member (1) and said cylindrical ring (6) are rotatable.

10. The machine of claim 9 wherein said center member (1) and cylindrical ring (6) are rotatable in mutually opposite directions.

* * * * *